US012523230B2

(12) United States Patent
Xia et al.

(10) Patent No.: US 12,523,230 B2
(45) Date of Patent: Jan. 13, 2026

(54) INFLATABLE PUMP, INFLATABLE ASSEMBLY, AND INFLATABLE PRODUCT

(71) Applicant: ZHEJIANG NATURAL OUTDOOR GOODS INC., Zhejiang (CN)

(72) Inventors: Yonghui Xia, Zhejiang (CN); Mengzhi Zhou, Zhejiang (CN); Weifeng Zhu, Zhejiang (CN)

(73) Assignee: ZHEJIANG NATURAL OUTDOOR GOODS INC., Zhejiang (CN)

( * ) Notice: Subject to any disclaimer, the term of this patent is extended or adjusted under 35 U.S.C. 154(b) by 0 days.

(21) Appl. No.: 18/263,519

(22) PCT Filed: Apr. 19, 2023

(86) PCT No.: PCT/CN2023/089237
§ 371 (c)(1),
(2) Date: Jul. 28, 2023

(87) PCT Pub. No.: WO2023/202622
PCT Pub. Date: Oct. 26, 2023

(65) Prior Publication Data

US 2025/0043792 A1 Feb. 6, 2025

(30) Foreign Application Priority Data

Apr. 20, 2022 (CN) ..... 202210417035.X

(51) Int. Cl.
*F04D 25/06* (2006.01)
*F04D 25/08* (2006.01)
(Continued)

(52) U.S. Cl.
CPC ..... *F04D 25/0673* (2013.01); *F04D 25/08* (2013.01); *F04D 29/42* (2013.01);
(Continued)

(58) Field of Classification Search
CPC ..... A47C 27/081; A47C 27/082; B63B 7/08; B63B 7/082; F04D 25/0673; F04D 25/08;
(Continued)

(56) References Cited

U.S. PATENT DOCUMENTS 6,295,693 B1 * 10/2001 Chou ..... F04D 29/626 141/66
7,128,525 B2 * 10/2006 Tsai ..... F04D 25/08 415/128
(Continued)

FOREIGN PATENT DOCUMENTS

CN 2569656 9/2003
CN 201071816 6/2008
(Continued)

*Primary Examiner* — Essama Omgba
*Assistant Examiner* — Joseph S. Herrmann
(74) *Attorney, Agent, or Firm* — Haynes and Boone, LLP

(57) ABSTRACT

Provided are an inflatable pump, an inflatable assembly, and an inflatable product, relating to the technical field of inflatable products, wherein the inflatable pump includes an inflatable pump housing, a mounting cavity is provided in the inflatable pump housing, a spacer plate is provided in the mounting cavity, and a first mounting slot and a second mounting slot are provided on an upper top cover; and a control assembly is provided in the first mounting slot, and a handle is rotatably configured in the second mounting slot.

16 Claims, 9 Drawing Sheets

(51) Int. Cl.

| | |
|---|---|
| ***F04D 29/42*** | (2006.01) |
| ***F04D 29/60*** | (2006.01) |
| ***F04D 29/62*** | (2006.01) |
| *A47C 27/08* | (2006.01) |
| *F04D 19/00* | (2006.01) |
| *F04D 29/50* | (2006.01) |

(52) U.S. Cl.
CPC ..... *F04D 29/601* (2013.01); *F04D 29/62* (2013.01); *A47C 27/082* (2013.01); *F04D 19/005* (2013.01); *F04D 29/503* (2013.01)

(58) Field of Classification Search
CPC ..... F04D 29/42; F04D 29/503; F04D 29/601; F04D 29/62; F04D 29/626; F04D 19/005; F04D 29/06
See application file for complete search history.

(56) References Cited

U.S. PATENT DOCUMENTS

| | | | | |
|---|---|---|---|---|
| 7,624,575 | B2 * | 12/2009 | Noelle | F02M 26/12 60/605.1 |
| 11,041,508 | B2 * | 6/2021 | Chen | F04D 25/0693 |
| 11,460,043 | B2 * | 10/2022 | Qin | F04D 29/602 |
| 2005/0079077 | A1 * | 4/2005 | Tsai | F04D 25/084 417/423.15 |
| 2006/0073045 | A1 * | 4/2006 | Tsai | F04D 27/00 417/423.1 |
| 2008/0109963 | A1 * | 5/2008 | Wang | A47C 27/082 5/710 |
| 2022/0065257 | A1 * | 3/2022 | Huang | F04D 19/005 |
| 2022/0136524 | A1 * | 5/2022 | Qin | F04D 29/601 415/182.1 |

FOREIGN PATENT DOCUMENTS

| | | |
|---|---|---|
| CN | 202274225 | 6/2012 |
| CN | 207784787 | 8/2018 |
| CN | 208595082 | 3/2019 |
| CN | 212296963 | 1/2021 |
| CN | 213088283 | 4/2021 |
| CN | 215486665 | 1/2022 |
| CN | 215486665 U * | 1/2022 |
| CN | 215486722 | 1/2022 |
| CN | 215950494 | 3/2022 |
| CN | 114658677 | 6/2022 |
| CN | 217421579 | 9/2022 |
| DE | 202014100140 | 4/2014 |

* cited by examiner

INFLATABLE PUMP, INFLATABLE ASSEMBLY, AND INFLATABLE PRODUCT

CROSS-REFERENCE TO RELATED APPLICATION

The present disclosure is a U.S. national stage application under 35 U.S.C. § 371 of International Patent Application No. PCT/CN2023/089237, titled "Inflatable pump, Inflatable Assembly, and Inflatable product," "filed Apr. 19, 2023, which claims the priority to a Chinese patent application with the filing No. 202210417035X filed with the Chinese Patent Office on Apr. 20, 2022 and entitled "Inflatable pump, Inflatable Assembly, and Inflatable product", the contents of which are incorporated herein in entirety by reference.

TECHNICAL FIELD

The present disclosure relates to the technical field of inflatable products, and in particular to an inflatable pump, an inflatable assembly, and an inflatable product.

BACKGROUND ART

In the existing traditional inflatable products, the volume of the integrated built-in pump is larger than that of the mobile inflatable pump, and there are problems such as air leakage, the requirement for the power supply, and inconvenient to carry outdoors; and once the pump is damaged, these inflatable products cannot be inflated.

At present, most of the inflatable mattresses with built-in pump have inflatable bed bodies; after a long time of use, it is prone to air leakage and inflatable bed bodies are poor in comfort experience, and are not suitable for uneven ground or long-term use in the outdoor environment. In addition, the pump body is large in volume and occupies a large area and the inflatable bed body also covers a large area; and it is generally needed to connect the external power supply during use, which is inconvenient in operation.

SUMMARY

The objective of the present disclosure is to provide an inflatable pump, an inflatable assembly, and an inflatable product to solve the technical problems of large built-in pumps inside inflatable beds and the air leakage of the inflatable bed.

In the first aspect, the present disclosure provides an inflatable pump, comprising an inflatable pump housing, wherein a mounting cavity is provided in the inflatable pump housing, and a spacer plate is provided in the mounting cavity, wherein the spacer plate divides the mounting cavity into an upper mounting cavity and a lower mounting cavity;

a drive motor is provided in the lower mounting cavity and a fan blade that is connected to the drive motor is provided in the upper mounting cavity; and an inflatable mounting tube is provided on a side of the inflatable pump housing, and the inflatable mounting tube is communicated with the upper mounting cavity;

an air cover plate is provided at an upper end of the upper mounting cavity, and an inlet hole is provided in the air cover plate concentrically set with the drive shaft of the drive motor;

an upper top cover is provided at the upper end of the inflatable pump housing, the upper top cover is provided at the upper end of the air cover plate, a venting hole that is communicated with the inlet hole is provided in the upper top cover, and a grille is provided in the venting hole; and the upper top cover is provided with a first mounting slot and a second mounting slot; and the first mounting slot is provided therein with a control assembly, and a handle is rotatably configured in the second mounting slot.

In an optional embodiment, the upper top cover, the air cover plate, and the spacer plate are all provided with connecting holes, wherein the connection holes are configured to enable the cables of the control assembly to extend into the lower mounting cavity.

In an optional embodiment, a lampshade is provided at the lower end of the lower mounting cavity; a lighting assembly and a battery are provided in the lower mounting cavity, wherein the battery supplies energy to the lighting assembly and the drive motor, and the cables of the control assembly are connected to the lighting assembly, the battery, and the drive motor, respectively.

In an optional embodiment, the inflatable pump housing is provided with a charging port for charging the battery, and a rubber plug is provided on the charging port.

The upper top cover of the inflatable pump provided by the present disclosure is provided with a control assembly and a handle thereon, so that when the inflatable pump is installed on the inflatable product, it is convenient to operate the inflatable pump through the control assembly, which avoids reserving space for operating the inflatable pump to conveniently operate the inflatable pump, and reduces the space occupied by the inflatable pump on the inflatable product, the overall size of the inflatable pump, and the probability of air leakage in inflatable products due to the built-in inflatable pump; and the inflatable pump is provided with a handle, which is convenient for the pick-and-place of the inflatable pump.

In a second aspect, the present disclosure provides an inflatable assembly, wherein it comprises the inflatable pump as described in any one of the preceding embodiments.

In an optional embodiment, it further comprises a fixing housing, wherein a fixing cavity is provided in the fixing housing, and a fixing opening is provided in the fixing housing, wherein the fixing opening is communicated with the fixing cavity; and the inflatable pump is provided in the fixing cavity.

In an optional embodiment, a blocking lid is provided at the upper end of the fixing housing, and the blocking lid is configured to block the fixing opening.

In an optional embodiment, the fixing housing is provided with a fixing slot, and the inflatable mounting tube is fixed to the fixing slot; and an air nozzle assembly is provided on the fixing housing, wherein one end of the air nozzle assembly is connected to the inflatable mounting tube and the other end is extended outside the fixing housing.

In an optional embodiment, the fixing slot is provided therein with a support frame, and the support frame is provided with an arc-shaped slot matching the inflatable mounting tube.

In an optional embodiment, the air nozzle assembly comprises an air nozzle connector, an air nozzle connection tube, and an air nozzle lid, wherein a valve piece is provided on the air nozzle lid;

the fixing housing is provided with a mounting hole, wherein the air nozzle connection tube is penetrated through the mounting hole; the air nozzle connector is provided inside the fixing housing and connected to the air nozzle connection tube; and the air nozzle lid is provided outside the fixing housing and screwed to the air nozzle connection tube.

In an optional embodiment, a fixing ring is provided on the fixing housing, and the fixing ring is provided outside the fixing housing and concentrically arranged with the mounting hole; and a sealing ring is sleeved over the fixing ring and the air nozzle lid enables the sealing ring to abut against an outer wall of the fixing housing.

In an optional embodiment, an end of the air nozzle connector that is away from the air nozzle lid is provided with a first opening; the other end of the air nozzle connector is provided with a support ring configured to abut against an inner wall of the fixing housing; and the air nozzle connector is sleeved on the air nozzle connection tube;

a pressing ring is formed by the outward extension of one end of the air nozzle connection tube, and screw threads are provided at the other end of the air nozzle connection tube; and the pressing ring abuts against the first opening, and the pressing ring is moved towards the air nozzle lid by rotating the air nozzle lid, which enables the air nozzle connection tube to have a tendency of moving towards the inner wall of the fixing housing; and the inflatable mounting tube is located in the first opening and is communicated with the air nozzle connection tube.

In an optional embodiment, a material of the air nozzle connector is TPU.

In an optional embodiment, the fixing housing is provided with a clamping plate, and the clamping plate is provided circumferentially along the upper end of the fixing housing.

The present disclosure also provides an inflatable assembly, which applies the above-mentioned inflatable pump, thus having all the beneficial effects of the inflatable pump.

In a third aspect, the present disclosure provides an inflatable product, comprising an inflatable assembly as described in any of the preceding embodiments.

In an optional embodiment, the inflatable product is a vehicle-mounted inflatable product.

In an optional embodiment, the inflatable product comprises an inflatable product body, and the inflatable product body comprises an outer housing and a filling body provided within the outer housing; and the inflatable assembly is provided on the outer housing.

In an optional embodiment, the clamping plate of the fixing housing of the inflatable assembly is welded to the outer housing; and the fixing opening of the fixing housing faces towards an outer side of the outer housing, and the air nozzle lid of the fixing housing is located inside the outer housing.

In an optional embodiment, the filling body is a sponge.

In an optional embodiment, the filling body comprises a base, and a plurality of support ribs are arranged at intervals in a first direction of the base;

a plurality of perforations are provided in the support ribs, which are arranged at intervals along the vertical direction of the first direction.

In an optional embodiment, the first direction is the length direction or the width direction of the base.

The present disclosure also provides an inflatable product that applies the above-mentioned inflatable assembly, thus having all the beneficial effects of an inflatable assembly.

BRIEF DESCRIPTION OF DRAWINGS

In order to more clearly illustrate the specific embodiments of the present disclosure or the technical solution in the prior art, the drawings required to be used in the description of the specific embodiment or prior art will be briefly introduced as follows. Obviously, the drawings described below are some embodiments of the present disclosure, for those of ordinary skill in the art, without paying creative labor, other drawings may also be obtained according to these drawings.

Figure 1:
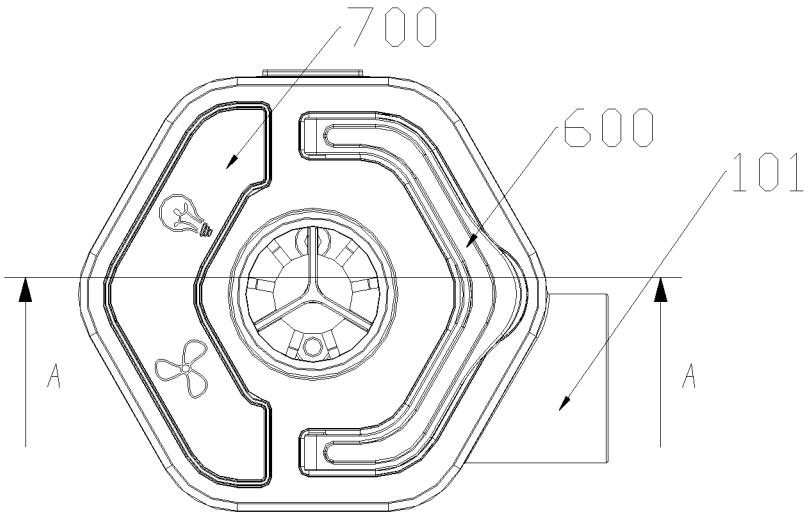
FIG. 1 is a schematic view of the structure of an inflatable pump according to an embodiment of the present disclosure.
Figure 2:
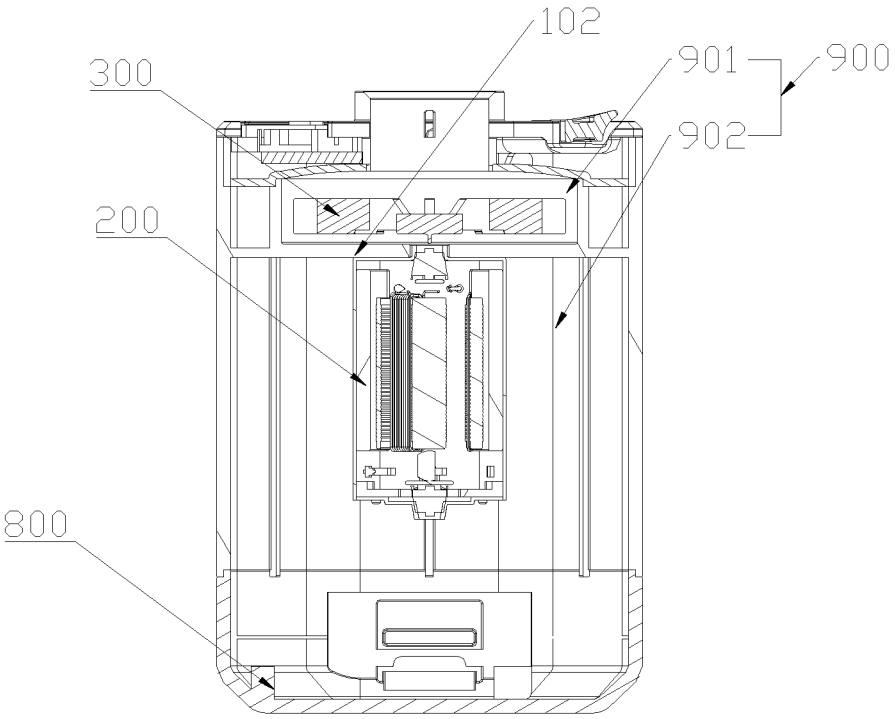
FIG. 2 is a schematic view of the structure of an A-A section of the inflatable pump shown in FIG. 1.
Figure 3:
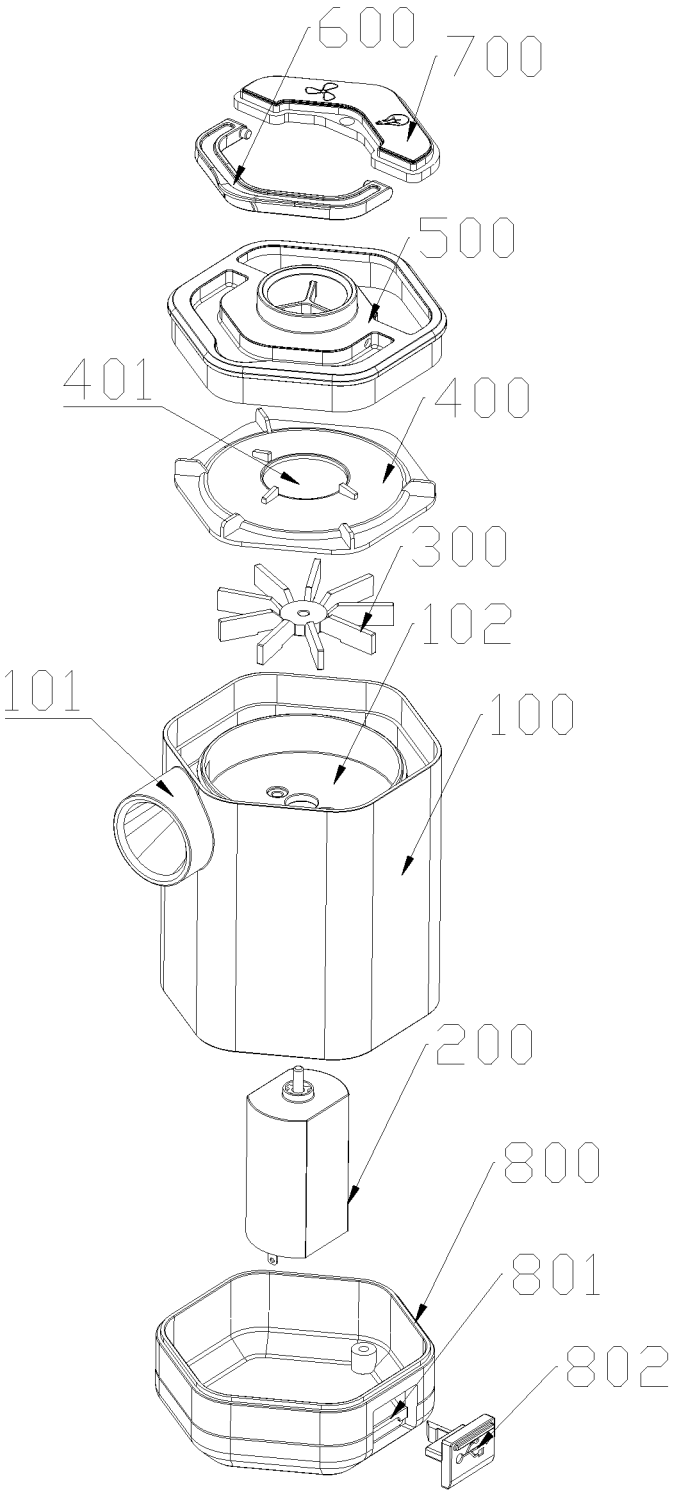
FIG. 3 is an exploded view of the inflatable pump shown in FIG. 1.
Figure 4:
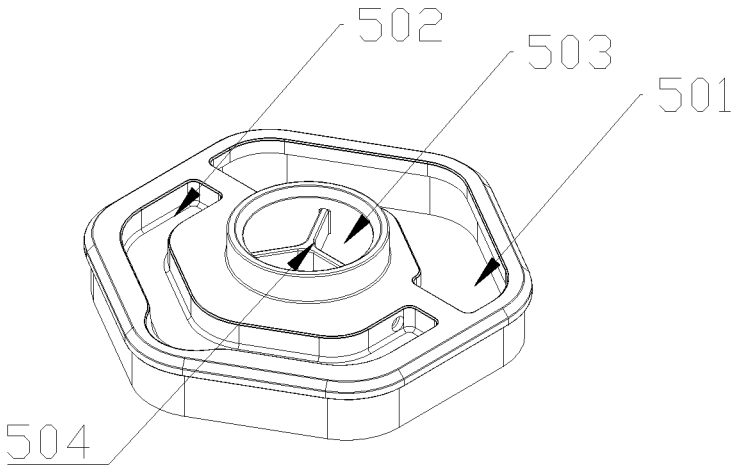
FIG. 4 is a schematic view of the structure of an upper top cover of the inflatable pump shown in FIG. 3.
Figure 5:
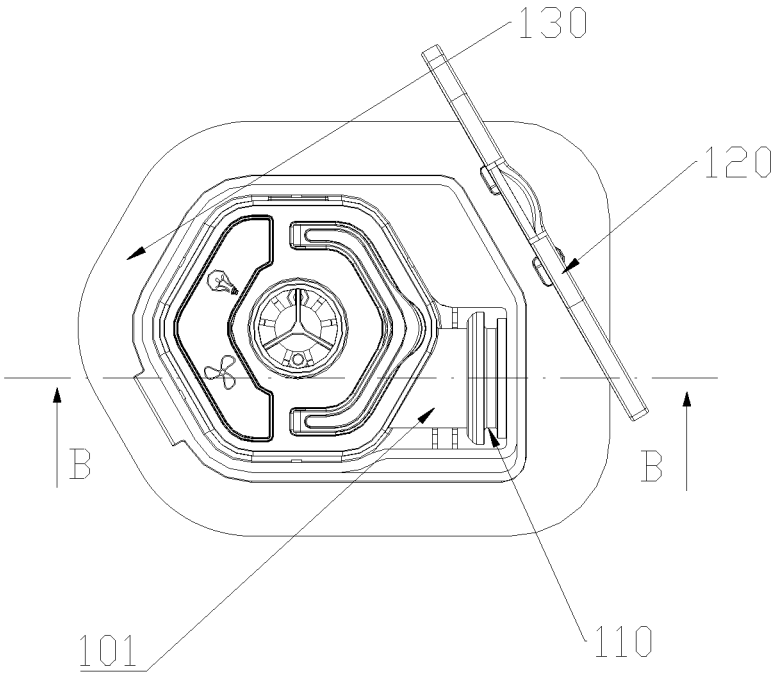
FIG. 5 is a schematic view of the structure of the inflatable assembly according to an embodiment of the present disclosure.
Figure 6:
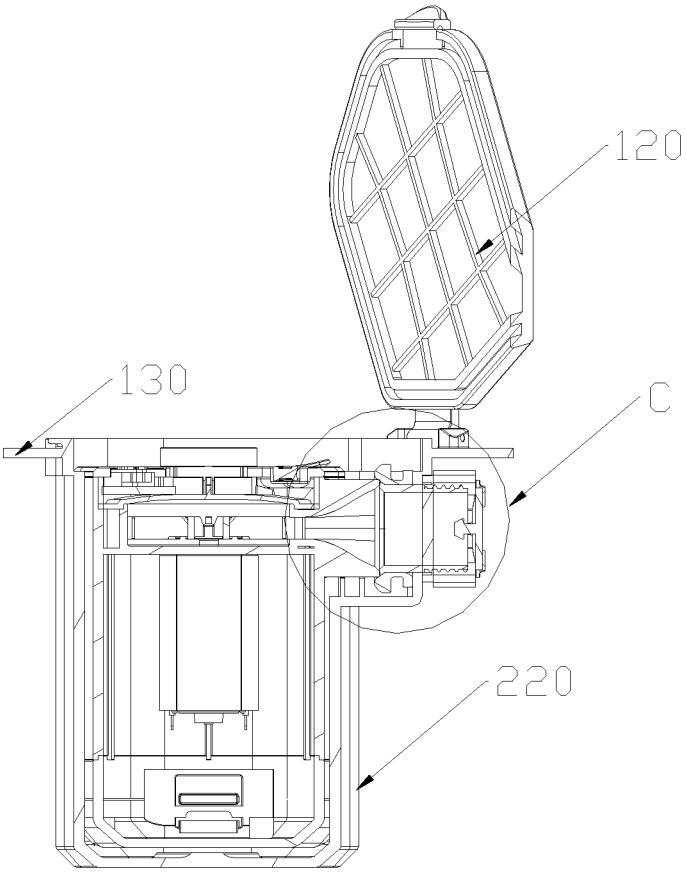
FIG. 6 is a schematic view of the structure of the B-B section of the inflatable assembly shown in FIG. 5.
Figure 7:
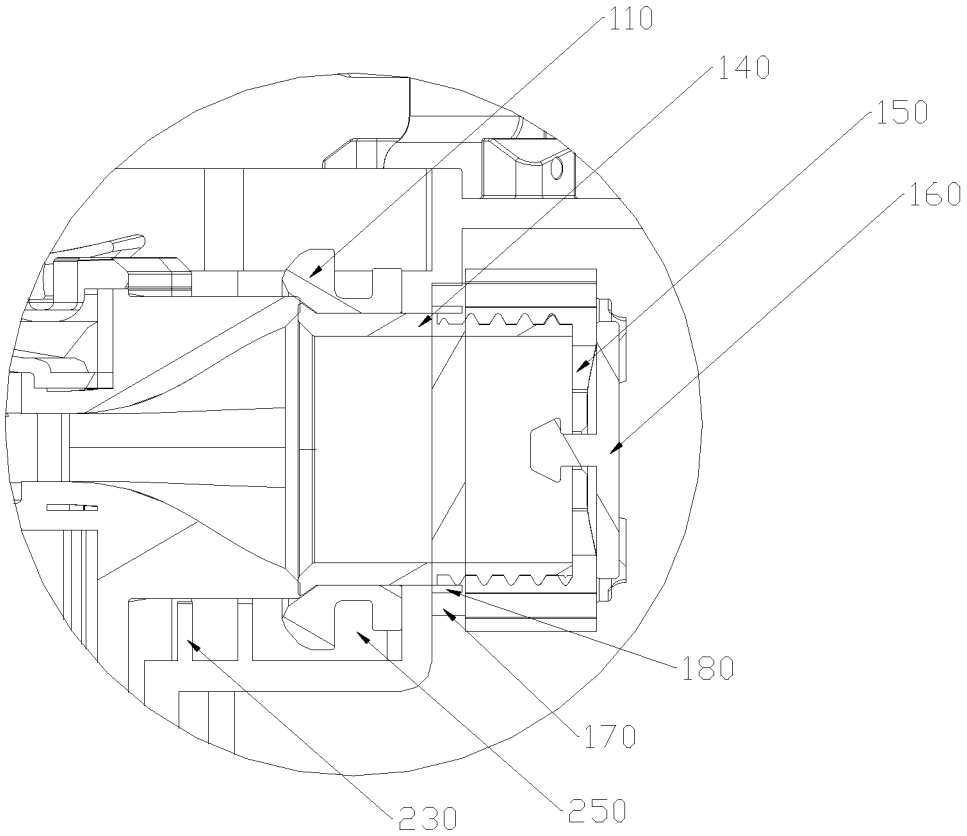
FIG. 7 is a partially enlarged view of C of schematic view of the structure of the B-B section of the inflatable assembly shown in FIG. 6.
Figure 8:
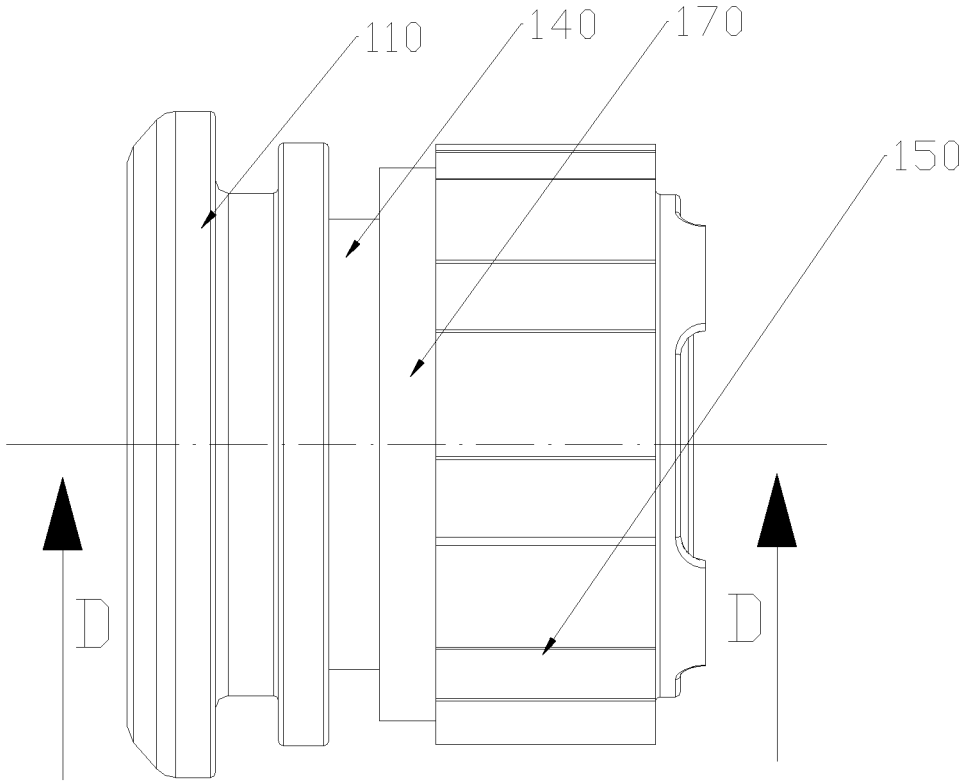
FIG. 8 is a schematic view of the structure of the air nozzle assembly of the inflatable assembly shown in FIG. 7.
Figure 9:
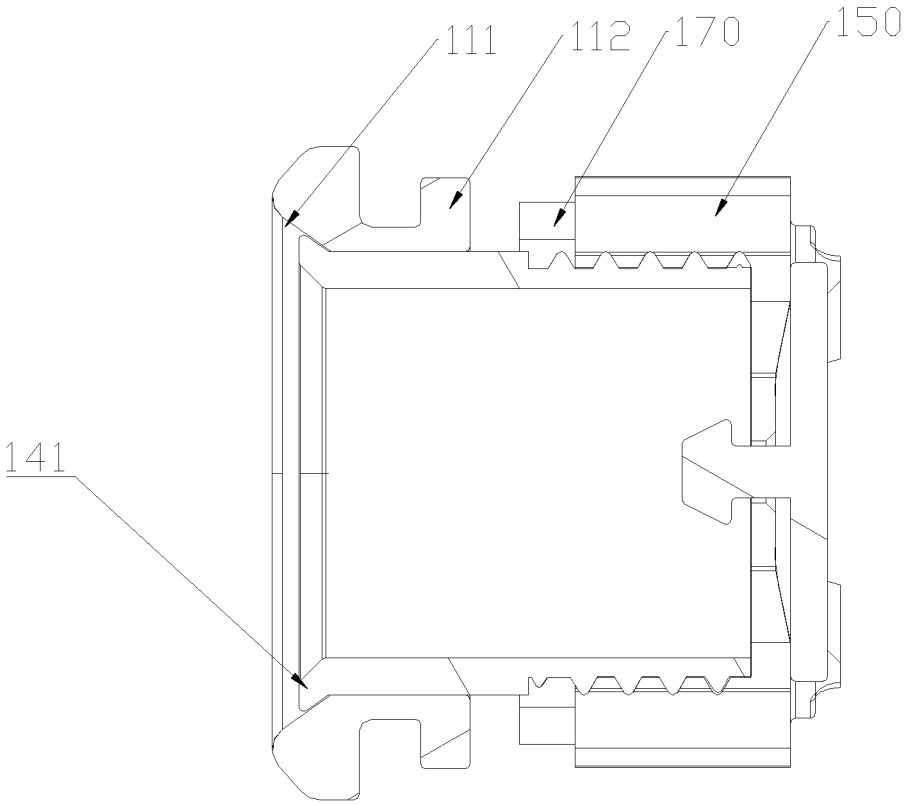
FIG. 9 is a schematic view of the structure of the D-D section of the air nozzle assembly shown in FIG. 8.
Figure 10:
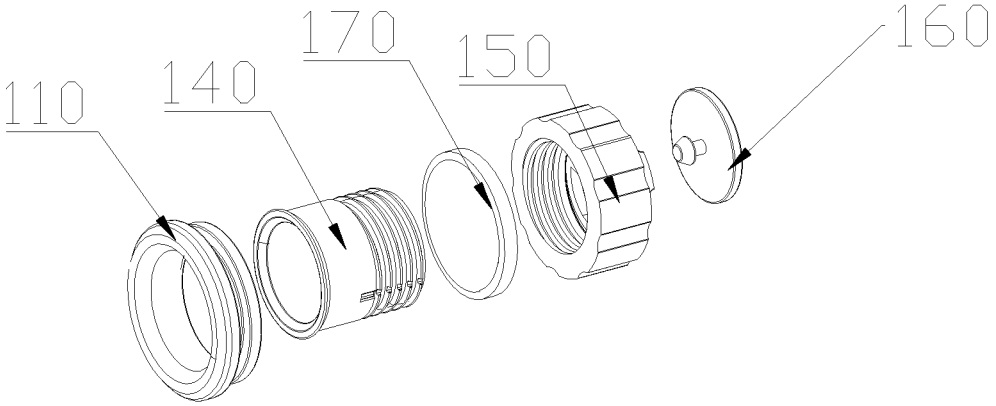
FIG. 10 is an exploded view of the air nozzle assembly shown in FIG. 8.
Figure 11:
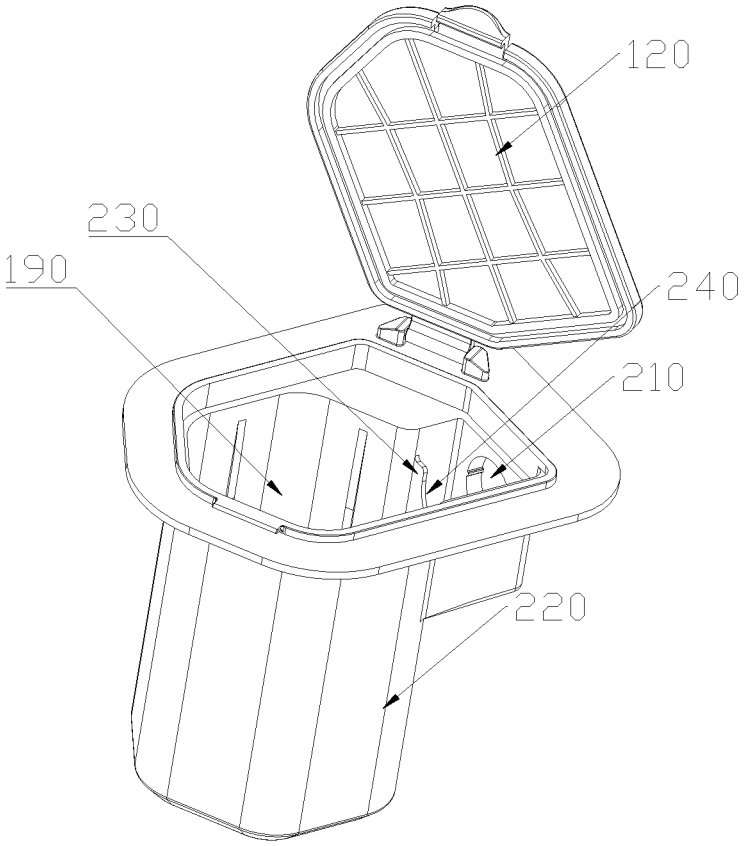
FIG. 11 is a schematic view of the structure of the fixing housing of the inflatable assembly shown in FIG. 7.

Reference numerals: 100—inflatable pump housing; 101—inflatable mounting tube; 102—spacer plate; 200—drive motor; 300—fan blade; 400—air cover plate; 401—inlet hole; 500—upper top cover; 501—first mounting slot; 502—second mounting slot; 503—venting hole; 504—grille; 600—handle; 700—control assembly; 800—lampshade; 801—charging port; 802—rubber plug; 900—mounting cavity; 901—upper mounting cavity; 902—lower mounting cavity; 110—air nozzle connector; 111—first opening; 112—support ring; 120—blocking lid; 130—clamping plate; 140—air nozzle connection tube; 141—pressing ring; 150—air nozzle lid; 160—valve piece; 170—sealing ring; 180—fixing ring; 190—fixing cavity; 210—mounting hole; 220—fixing housing; 230—support frame; 240—arc-shaped slot; 250—fixing slot; 260—outer housing; 270—base; 280—support rib; 290—perforation.

DETAILED DESCRIPTION OF EMBODIMENTS

A clear and complete description of the technical solutions of the present disclosure will be given below in connection with embodiments that are clearly part of and not all of the embodiments of the present disclosure. Based on the embodiments in the present disclosure, all other embodiments obtained by those of ordinary skill in the art without making inventive efforts are within the scope of protection of the present disclosure.

Embodiment

Referring to FIGS. 1-4, the present disclosure provides an inflatable pump, wherein it comprises an inflatable pump housing 100, wherein a mounting cavity 900 is provided in the inflatable pump housing 100, a spacer plate 102 is provided in the mounting cavity 900, and the spacer plate 102 divides the mounting cavity 900 into an upper mounting cavity 901 and a lower mounting cavity 902;

a drive motor 200 is provided in the lower mounting cavity 902 and a fan blade 300 that is connected to the drive motor 200 is provided in the upper mounting cavity 901; and an inflatable mounting tube 101 is provided on a side of the inflatable pump housing 100, and the inflatable mounting tube 101 is communicated with the upper mounting cavity 901;

an air cover plate 400 is provided at an upper end of the upper mounting cavity 901, and an inlet hole 401 is provided in the air cover plate 400 concentrically set with the drive shaft of the drive motor 200;

an upper top cover 500 is provided at the upper end of the inflatable pump housing 100, the upper top cover 500 is provided at the upper end of the air cover plate 400, a venting hole 503 that is communicated with the inlet hole 401 is provided in the upper top cover 500, and a grille 504 is provided in the venting hole 503; and the upper top cover 500 is provided with a first mounting slot 501 and a second mounting slot 502; and the first mounting slot 501 is provided therein with a control assembly 700, and a handle 600 is rotatably configured in the second mounting slot 502.

In some embodiments, the inflatable pump housing 100 of the inflatable pump is provided therein with a mounting cavity 900, and a spacer plate 102 provided in the mounting cavity 900 divides the mounting cavity 900 into an upper mounting cavity 901 and a lower mounting cavity 902; a drive motor 200 is located in the lower mounting cavity 902, and a drive shaft of the drive motor 200 is located in the upper mounting cavity 901, and a fan blade 300 is provided on the drive shaft; and the drive motor 200 enables the fan blade 300 to rotate, such that the air is introduced into the inflatable mounting tube 101 after entering through the inlet hole 401, so as to inflate the inflatable product that is connected to the inflatable mounting tube 101.

The air cover plate 400 is arranged in the upper mounting cavity 901, wherein the air cover plate 400 seals the upper opening of the upper mounting cavity 901, so that the upper mounting cavity 901 forms an air cavity; and the upper top cover 500 is arranged at the upper end of the inflatable pump housing 100, and the upper top cover 500 is provided with a venting hole 503. For avoiding larger foreign matters from entering the venting hole 503, a grille 504 is arranged in the venting hole 503, wherein the grille 504 is generally a Y-shaped grille 504. When the fan rotates, the air enters through the venting hole 503, then enters the inlet hole 401, and finally enters the inflatable mounting tube 101.

A first mounting slot 501 can be provided on the upper top cover 500 for the arrangement of the control assembly 700, wherein the control assembly 700 is able to control the drive motor 200 to be turned on and off, and perform some other operations; and the control assembly 700 is provided with a rubber button, and the rubber button is provided with the corresponding function labels.

In order to facilitate the movement of the inflatable pump, there is a handle 600 in the second mounting slot 502, wherein the handle 600 can be screwed out of the second mounting slot 502, and thus the handle 600 realizes the function of the handle 600; and when the handle 600 is not in need, the handle 600 can be screwed into the second mounting slot 502, so that the handle 600 can be well placed, thus avoiding the use of the inflatable product from being affected by the handle 600.

In an optional embodiment, the upper top cover 500, the air cover plate 400, and the spacer plate 102 are all provided with connecting holes, wherein the connecting holes are configured to enable the cables of the control assembly 700 to extend into the lower mounting cavity 902.

In an optional embodiment, the lower mounting cavity 902 is provided with a lampshade 800 at the lower end thereof; a lighting assembly and a battery are provided in the lower mounting cavity 902, wherein the battery supplies energy to the lighting assembly and the drive motor 200, and the cables of the control assembly 700 are connected to the lighting assembly, the battery and the drive motor 200, respectively.

A lighting assembly is provided in the lower mounting cavity 902, wherein the lighting assembly is generally an LED lamp; a battery provides electrical energy for the lighting assembly; and the inflatable pump can also be used for lighting when the inflatable pump is used outdoors.

The cables of the control assembly 700 provided on the upper top cover 500 can be connected to the drive motor 200, the battery, and the lighting assembly, respectively, after passing through the connecting holes which are on the upper top cover 500, the air cover plate 400 and the spacer plate 102 in sequence; and the switch on and off of the drive motor 200 and the lighting assembly can be realized through the control assembly 700.

In an optional embodiment, the inflatable pump housing 100 is provided with a charging port 801 for charging the battery, and a rubber plug 802 is provided on the charging port 801.

In order to facilitate the charging of the battery, there is a charging port 801 provided at the lower end of the inflatable pump housing 100, wherein the charging port 801 is provided with a rubber plug 802, wherein the rubber plug 802 blocks the charging port 801 to avoid foreign objects from entering the charging port 801 in the state of non-charging.

The upper top cover 500 of the inflatable pump provided by the present disclosure is provided thereon with a control assembly 700 and a handle 600 so that when the inflatable pump is installed on the inflatable product, it is convenient to operate the inflatable pump through the control assembly 700, which avoids reserving space for operating the inflatable pump to conveniently operate the inflatable pump, and reduces the space occupied by the inflatable pump on the inflatable product, the overall size of the inflatable pump, and the probability of air leakage in inflatable products due to the built-in inflatable pump; and the inflatable pump is provided with a handle 600, which is convenient for the pick-and-place of the inflatable pump.

Referring to FIGS. 5-11, the present disclosure provides an inflatable assembly, wherein it comprises the inflatable pump as described in any one of the preceding embodiments.

In an optional embodiment, it further comprises a fixing housing 220, a fixing cavity 190 is provided in the fixing housing 220, and a fixing opening is provided in the fixing housing 220, wherein the fixing opening is communicated with the fixing cavity 190; and the inflatable pump is provided in the fixing cavity 190.

In an optional embodiment, the fixing housing 220 is provided with a blocking lid 120 at the upper end thereof, and the blocking lid 120 is configured to block the fixing opening.

In some embodiments, the inflatable assembly includes an inflatable pump and a fixing housing 220, wherein the fixing housing 220 is generally fixed to the inflatable product, and the inflatable pump is able to enter the fixing cavity 190 of the fixing housing 220 from the fixing opening; the cross-section of the inflatable pump is generally non-circular, wherein it is commonly shaped as a polygon, such as hexagon, mostly regular hexagon; the fixing cavity 190 is of a shape matching with the inflatable pump; and a raised reinforcing rib is generally provided in the fixing cavity 190 to improve the matching degree of the inflatable pump and the fixing housing 220.

A blocking lid 120 is provided on the fixing housing 220, wherein the blocking lid 120 is able to block the fixing opening, and then fix the inflatable pump in the fixing housing 220. When the inflatable pump is needed to be removed from the fixing housing 220, the handle 600 in the second mounting slot 502 on the upper top cover 500 is lifted up, and then the inflatable pump will be removed from or put into the fixing housing 220.

In an optional embodiment, the fixing housing 220 is provided with a fixing slot 250, and the inflatable mounting tube 101 is fixed to the fixing slot 250; and an air nozzle assembly is provided on the fixing housing 220, wherein one end of the air nozzle assembly is connected to the inflatable mounting tube 101 and the other end is extended outside the fixing housing 220.

In an optional embodiment, the fixing slot 250 is provided therein with a support frame 230, and the support frame 230 is provided with an arc-shaped slot 240 matching the inflatable mounting tube 101.

A fixing slot 250 is provided on the fixing housing 220, and a support frame 230 is provided in the fixing slot 250. The arc-shaped slot 240 of the support frame 230 firmly fixes the inflatable mounting tube 101 on the support frame 230, so that the inflatable mounting tube 101 can be firmly connected to the air nozzle assembly.

In an optional embodiment, the air nozzle assembly comprises an air nozzle connector 110, an air nozzle connection tube 140, and an air nozzle lid 150, wherein a valve piece 160 is provided on the air nozzle lid 150; and the fixing housing 220 is provided with a mounting hole 210, wherein the air nozzle connection tube 140 is penetrated in the mounting hole 210; the air nozzle connector 110 is provided inside the fixing housing 220 and connected to the air nozzle connection tube 140; and the air nozzle lid 150 is provided outside the fixing housing 220 and screwed to the air nozzle connection tube 140.

In an optional embodiment, a fixing ring 180 is provided on the fixing housing 220, and the fixing ring 180 is provided outside the fixing housing 220 and concentrically arranged with the mounting hole 210; and a sealing ring 170 is sleeved over the fixing ring 180, and the air nozzle lid 150 enables the sealing ring 170 to abut against an outer wall of the fixing housing 220.

In an optional embodiment, an end of the air nozzle connector 110 that is away from the air nozzle lid 150 is provided with a first opening 111; the other end of the air nozzle connector 110 is provided with a support ring 112 configured to abut against an inner wall of the fixing housing 220; and the air nozzle connector 110 is sleeved on the air nozzle connection tube 140.

A pressing ring 141 is formed by the outward extension of one end of the air nozzle connection tube 140, and screw threads are provided at the other end of the air nozzle connection tube 140; and the pressing ring 141 abuts against the first opening 111, and the pressing ring 141 is moved towards the air nozzle lid 150 by rotating the air nozzle lid 150, which enables the air nozzle connection tube 140 to have a tendency of moving towards the inner wall of the fixing housing 220.

The inflatable mounting tube 101 is located in the first opening 111 and is communicated with the air nozzle connection tube 140.

In an optional embodiment, a material of the air nozzle connector 110 is TPU.

In some embodiments, the air nozzle connection tube 140 of the air nozzle connector 110 is provided in the mounting hole 210, wherein the air nozzle connector 110 is located inside the fixing housing 220; and the air nozzle connection tube 140 is inserted from one end of the air nozzle connector 110, and the other end extends outside the fixing housing 220 and is screwed to the air nozzle lid 150. The air nozzle connection tube 140 is moved outward by rotating the air nozzle lid 150, by which the air nozzle connector 110 is moved toward the inner wall of the fixing housing 220 so that the air nozzle connector 110 abuts against the inner wall of the fixing housing 220.

The air nozzle connection tube 140 is inserted into the air nozzle connector 110 from one end of the first opening 111 of the air nozzle connector 110, and the air nozzle connection tube 140 applies pressure to the air nozzle connector 110 through the pressing ring 141 to move the air nozzle connector 110 toward the inner wall of the fixing housing 220. Since the material of the air nozzle connector 110 is TPU, the air nozzle connector 110 is capable of being deformed. The inflatable mounting tube 101 can be communicated with the air nozzle connection tube 140, wherein the air nozzle connector 110 is located outside the connection position of the inflatable mounting tube 101 and the air nozzle connection tube 140; and the air nozzle connector 110 is configured to seal the connection position of the inflatable mounting tube 101 and the air nozzle connection tube 140, where the air nozzle connector 110 is located at.

The fixing ring 180 on the outer side of the fixing housing 220 is concentrically arranged with the mounting hole 210; a sealing ring 170 is set outside the fixing ring 180; and the air nozzle lid 150 is able to enable the sealing ring 170 to abut against the outer wall of the fixing housing 220, so as to avoid air leakage from the gap between the air nozzle lid 150 and the air nozzle connection tube 140.

The air nozzle connection tube 140 is provided with a clamping groove, and the mounting hole 210 is provided therein with a fixing projection matching the clamping groove, so that after the air nozzle connection tube 140 is set in the mounting hole 210, the air nozzle connection tube 140 does not rotate relatively to the mounting hole 210.

In an optional embodiment, the fixing housing 220 is provided with a clamping plate 130, and the clamping plate 130 is provided circumferentially along the upper end of the fixing housing 220.

For a better connection of the fixing housing 220 and the inflatable product, generally, the fixing housing 220 is provided with a clamping plate 130, wherein the inflatable product and the clamping plate 130 are connected by welding, a sealing layer of the TPU material of the inflatable product is welded to the clamping plate 130, and then the fixing housing 220 is fixed on the inflatable product. In the prior art, the inflatable product has a built-in pump, and how to fix the built-in pump and the inflatable product belongs to prior art.

The present disclosure also provides an inflatable assembly that applies the above-mentioned inflatable pump, thus having all the beneficial effects of an inflatable pump.

Figure 12:
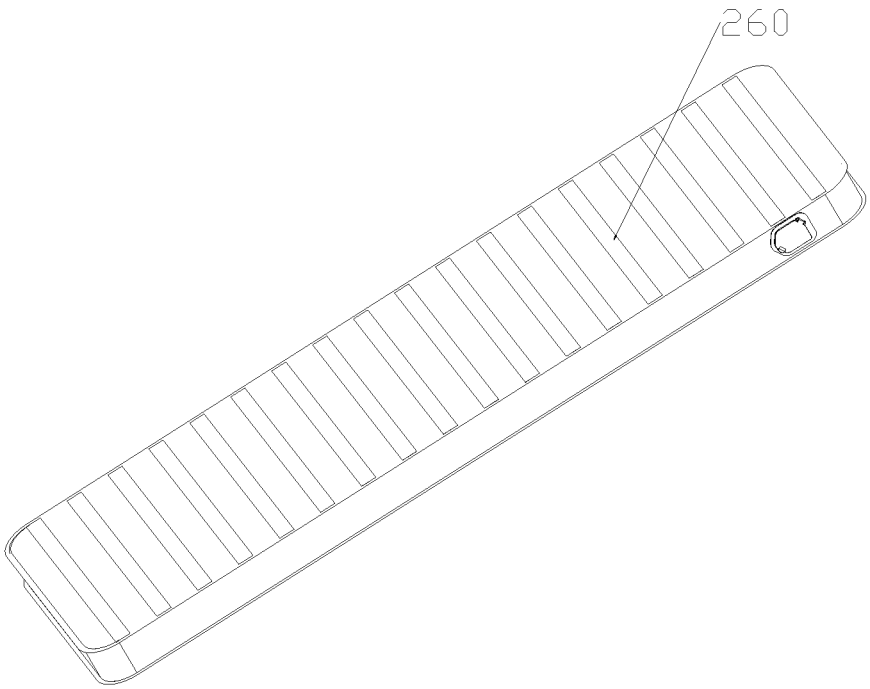
FIG. 12 is a schematic view of the structure of the inflatable product according to an embodiment of the present disclosure.
Figure 13:
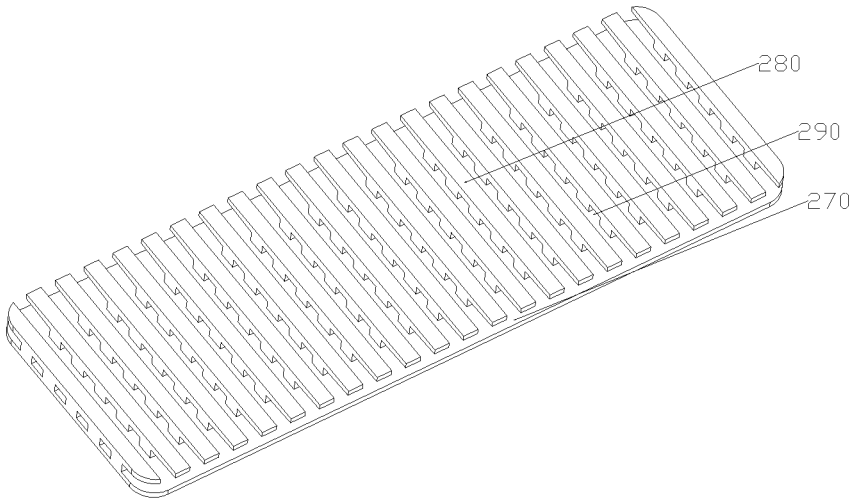
FIG. 13 is a schematic view of the structure of a filling body of the inflatable product shown in FIG. 12.

Referring FIGS. 12-13, the present disclosure provides an inflatable product, comprising an inflatable assembly as described in any of the preceding embodiments.

In an optional embodiment, the inflatable product is a vehicle-mounted inflatable product.

The inflatable products apply the above inflatable assembly, wherein the inflatable products can be inflatable mattresses, inflatable sofas, etc., and also can be vehicle-mounted inflatable products, such as vehicle-mounted inflatable mattresses. By arranging the inflatable pump with smaller volume into the inflatable mattress, it is easy to carry the inflatable mattress.

The inflatable mattress can be provided with an inflatable handrail on both sides along the length direction, respectively, so that the inflatable mattress is able to have the function of handrails, thus improving the stability of the sleep process while giving users a better sleep experience.

In an optional embodiment, the inflatable product comprises an inflatable product body, and the inflatable product body comprises an outer housing 260 and a filling body provided within the outer housing 260; and the inflatable assembly is provided on the outer housing 260.

In an optional embodiment, the clamping plate 130 of the fixing housing 220 of the inflatable assembly is welded to the outer housing 260; and the fixing opening of the fixing housing 220 faces towards an outer side of the outer housing 260, and the air nozzle lid 150 of the fixing housing 220 is located inside the outer housing 260.

In an optional embodiment, the filling body is a sponge.

In an optional embodiment, the filling body comprises a base 270, and a plurality of support ribs 280 are provided at intervals in a first direction of the base 270; and a plurality of perforations 290 are provided in the support ribs 280, which are arranged at intervals along the vertical direction of the first direction.

In an optional embodiment, the first direction is the length direction or the width direction of the base 270.

In some embodiments, the outer housing 260 of the inflatable product body of the inflatable product adopts a TPU material, wherein the outer housing 260 has a filling body therein. Generally, the filling body is a sponge. The TPU material is environmentally friendly, and has strong abilities of strain, tension, toughness, and resistance to aging, cold and dirty, which is suitable for use in the outdoor or vehicle-mounted environment. The filling body increases comfort.

The structure of the filling body effectively reduces the volume of the filling body, the weight of the filling body products, and the storage volume at the same time; it is convenient for compression and folding and is softer after air inflation, which fits the human body and improves the comfort of the mattress.

The cutting method of the filling body enables a whole sponge to be cut symmetrically to form two products, and the design scheme of the product can take a cutting method of "one to two" for the sponge when cutting the sponge, which only produces a very rare amount of sponge loss during production, greatly reducing the loss of sponge, saving costs and being more friendly to the environment.

The inflatable product is provided with a built-in inflatable pump, which is convenient for the inflatable product to be air-refilled in real time, making the inflatable product more saturated to enhance the supporting ability. In order to facilitate the deflation of the inflatable product, additional air nozzles can be arranged on the outer housing 260, thus improving the efficiency of inflating and deflating of the inflatable product.

The present disclosure also provides an inflatable product to achieve the function of inflating and pumping the inflatable products, reducing human operation, which is convenient, fast, and easy to store. Compared with the existing inflatable bed with pump, the inflatable product of the present disclosure has higher comfort, smaller size, and better operation; compared with the traditional mattress structure, it is more comfortable, lighter in weight, and has high utilization of sponge.

Finally, it should be noted that the above embodiments are only used to illustrate the technical solution of the present disclosure, not to limit it; while the present disclosure has been described in detail with reference to the preceding embodiments, it will be understood by those of ordinary skill in the art that, one may still modify the technical solution described in the preceding embodiments, or replace some or all of the technical features therein equally; and these modifications or substitutions do not depart the essence of the corresponding technical solution from the scope of the technical solution of the embodiments of the present disclosure.

What is claimed is:

1. An inflatable assembly, comprising:

an inflatable pump housing, wherein a mounting cavity is provided in the inflatable pump housing, a spacer plate is provided in the mounting cavity, and the spacer plate divides the mounting cavity into an upper mounting cavity and a lower mounting cavity;

a drive motor provided in the lower mounting cavity and a fan blade connected to the drive motor is provided in the upper mounting cavity; and an inflatable mounting tube is provided on a side of the inflatable pump housing, and the inflatable mounting tube is communicated with the upper mounting cavity;

an air cover plate provided at an upper end of the upper mounting cavity, and an inlet hole is provided in the air cover plate concentrically set with a drive shaft of the drive motor;

an upper top cover provided at an upper end of the inflatable pump housing, the upper top cover provided at an upper end of the air cover plate, a venting hole that is communicated with the inlet hole provided in the upper top cover, and a grille is provided in the venting hole, wherein the upper top cover is provided with a first mounting slot and a second mounting slot; and wherein the first mounting slot is provided therein with a control assembly and a handle is rotatably configured in the second mounting slot; and a fixing housing, wherein a fixing cavity is provided in the fixing housing, and a fixing opening is provided in the fixing housing, wherein the fixing opening is communicated with the fixing cavity; and an inflatable pump is provided in the fixing cavity, wherein the fixing housing is provided with a fixing slot, and the inflatable mounting tube is fixed to the fixing slot; and an air nozzle assembly is provided on the fixing housing, wherein one end of the air nozzle assembly is connected to the inflatable mounting tube and the other end is extended outside the fixing housing, and wherein the air nozzle assembly comprises an air nozzle connector, an air nozzle connection tube, and an air nozzle lid; wherein a valve piece is provided on the air nozzle lid; wherein the fixing housing is provided with a mounting hole, wherein the air nozzle connection tube is penetrated in the mounting hole; wherein the air nozzle connector is provided inside the fixing housing and connected to the air nozzle connection tube; and wherein the air nozzle lid is provided outside the fixing housing and screwed to the air nozzle connection tube.

2. The inflatable assembly according to claim 1, wherein a blocking lid is provided at an upper end of the fixing housing, and the blocking lid is configured to block the fixing opening.

3. The inflatable assembly according to claim 1, wherein the fixing slot is provided therein with a support frame, and the support frame is provided with an arc-shaped slot matching the inflatable mounting tube.

4. The inflatable assembly according to claim 1, wherein a fixing ring is provided on the fixing housing, and the fixing ring is provided outside the fixing housing and concentrically arranged with the mounting hole; and a sealing ring is sleeved over the fixing ring and the air nozzle lid enables the sealing ring to abut against an outer wall of the fixing housing.

5. The inflatable assembly according to claim 1, wherein an end of the air nozzle connector that is away from the air nozzle lid is provided with a first opening; wherein the other end of the air nozzle connector is provided with a support ring configured to abut against an inner wall of the fixing housing; wherein the air nozzle connector is sleeved on the air nozzle connection tube; wherein a pressing ring is formed by an outward extension of one end of the air nozzle connection tube and screw threads are provided at the other end of the air nozzle connection tube; and the pressing ring abuts against the first opening, wherein the pressing ring is moved towards the air nozzle lid by rotating the air nozzle lid, which enables the air nozzle connection tube to have a tendency of moving towards the inner wall of the fixing housing; and wherein the inflatable mounting tube is located in the first opening and is communicated with the air nozzle connection tube.

6. The inflatable assembly according to claim 1, wherein a material of the air nozzle connector is TPU.

7. The inflatable assembly according to claim 1, wherein the fixing housing is provided with a clamping plate, and the clamping plate is provided circumferentially along an upper end of the fixing housing.

8. An inflatable product, comprising the inflatable assembly according to claim 1.

9. The inflatable product according to claim 8, wherein the inflatable product is a vehicle-mounted inflatable product.

10. The inflatable product according to claim 8, comprising an inflatable product body, wherein the inflatable product body comprises an outer housing and a filling body provided within the outer housing; and wherein the inflatable assembly is provided on the outer housing.

11. The inflatable product according to claim 10, wherein a clamping plate of a fixing housing of the inflatable assembly is welded to the outer housing; and a fixing opening of the fixing housing faces towards an outer side of the outer housing, and an air nozzle lid of the fixing housing is located inside the outer housing.

12. The inflatable product according to claim 10, wherein the filling body is a sponge.

13. The inflatable product according to claim 12, wherein the filling body comprises a base, and a plurality of support ribs are provided at intervals in a first direction of the base; and wherein a plurality of perforations are provided in the support ribs, which are arranged at intervals along a vertical direction of the first direction.

14. The inflatable assembly according to claim 1, wherein the upper top cover, the air cover plate, and the spacer plate are all provided with connecting holes, and the connecting holes are configured to enable cables of the control assembly to extend into the lower mounting cavity.

15. The inflatable assembly according to claim 14, wherein a lampshade is provided at a lower end of the lower mounting cavity and a lighting assembly and a battery is provided in the lower mounting cavity; and the battery supplies energy to the lighting assembly and the drive motor, and the cables of the control assembly are connected to the lighting assembly, the battery and the drive motor, respectively.

16. The inflatable assembly according to claim 15, wherein the inflatable pump housing is provided with a charging port for charging the battery, and a rubber plug is provided on the charging port.

* * * * *